United States Patent [19]

Box et al.

[11] 4,304,370

[45] Dec. 8, 1981

[54] STRIP FEED MECHANISM

[75] Inventors: William A. Box, Bethel Park Borough, Pa.; John W. Rogers, Shaker Heights, Ohio

[73] Assignees: John W. Rogers, Longboat Key, Fla.; U.S. Steel Corporation, Pittsburgh, Pa.

[21] Appl. No.: 129,964

[22] Filed: Mar. 13, 1980

[51] Int. Cl.[3] ..... B21C 47/16; B65H 59/00

[52] U.S. Cl. ..... 242/78.6; 242/75.5

[58] Field of Search ..... 242/75.5, 75.2, 75.3, 242/75.52, 78.6, 75.51, 78.7, 55

[56] References Cited

U.S. PATENT DOCUMENTS

| | | | |
|---|---|---|---|
| 3,038,681 | 6/1962 | Herr | 242/78.6 |
| 3,534,918 | 10/1970 | Clark | 242/55 |
| 3,810,591 | 5/1974 | Haven | 242/78.6 |
| 3,933,322 | 1/1976 | Satzinger | 242/78.6 |
| 4,249,705 | 2/1981 | Brooks | 242/78.6 |

*Primary Examiner*—Edward J. McCarthy
*Attorney, Agent, or Firm*—John F. Carney

[57] ABSTRACT

Apparatus is described by means of which sheet metal strip, unwound from a coil construct having a vertical axis of rotation, is fed to a strip processing station at regulated rates. The feed rate control mechanism is particularly adapted to accommodate strip that is twisted prior to exiting the apparatus to enable it to enter the strip processing station in a generally surface-horizontal attitude. The apparatus is arranged to occupy a minimum amount of floor space.

7 Claims, 3 Drawing Figures

STRIP FEED MECHANISM

BACKGROUND OF THE INVENTION

Sheet metal strip feeding apparatus are well-known in which coils of wound strip material are disposed horizontally on a rotatable platform in order to unwind the strip for feeding to a processing station, such as for example, a stamping press or the like. If the coils are relatively light weight feeding can be accomplished by means of power operated pinch rolls located downstream of the processing station that pull the strip at a desired rate therethrough, such pulling of the strip causing the platform, which is journalled for rotation, to simply turn under the force of the strip that exits the coil tangentially.

If, on the other hand, the coil is of great weight or if several coils are stacked on the platform in axially-spaced relation, it is necessary to positively drive the platform. Such apparatus normally employ speed control devices including a pivotable arm across which the strip material is looped prior to entering the processing station and which arm is sensitive to tension on the strip to regulate the platform drive in response thereto.

Problems are encountered, however, when it is desired to feed strip material at controlled rates from a horizontally disposed coil on a positively driven platform to a processing station adapted to receive the material in a surface-horizontal attitude. In such instances, it is necessary to twist the strip through ninety degrees between the point it leaves the coil and prior to its entering the processing station. Since sheet metal strip is relatively stiff transversely of its surface twisting can be accomplished only after an adequate amount of material has been unwound from the coil creating the need for a great length of work space.

It is known that the amount of work space required to effect twisting of strip can be reduced if the strip is caused to be removed from the coil in a direction opposite that in which it is fed to the processing station and caused to rise out of the plane of the coil whereby the direction of travel can easily be reversed toward the desired direction. Apparatus capable of performing this function are manufactured by P-A Industries of Bloomfield, Conn. Such apparatus have the undesirable feature, however, that they do not incorporate a positively driven platform and, therefore, cannot accommodate coils of great weight or a construct of stacked coils.

It is an improved apparatus of the described type capable of positively driving the rotatable platform at controlled rates in order to accommodate coils of great weight or multi-coil constructs that the present invention is directed.

SUMMARY OF THE INVENTION

Figure 1:
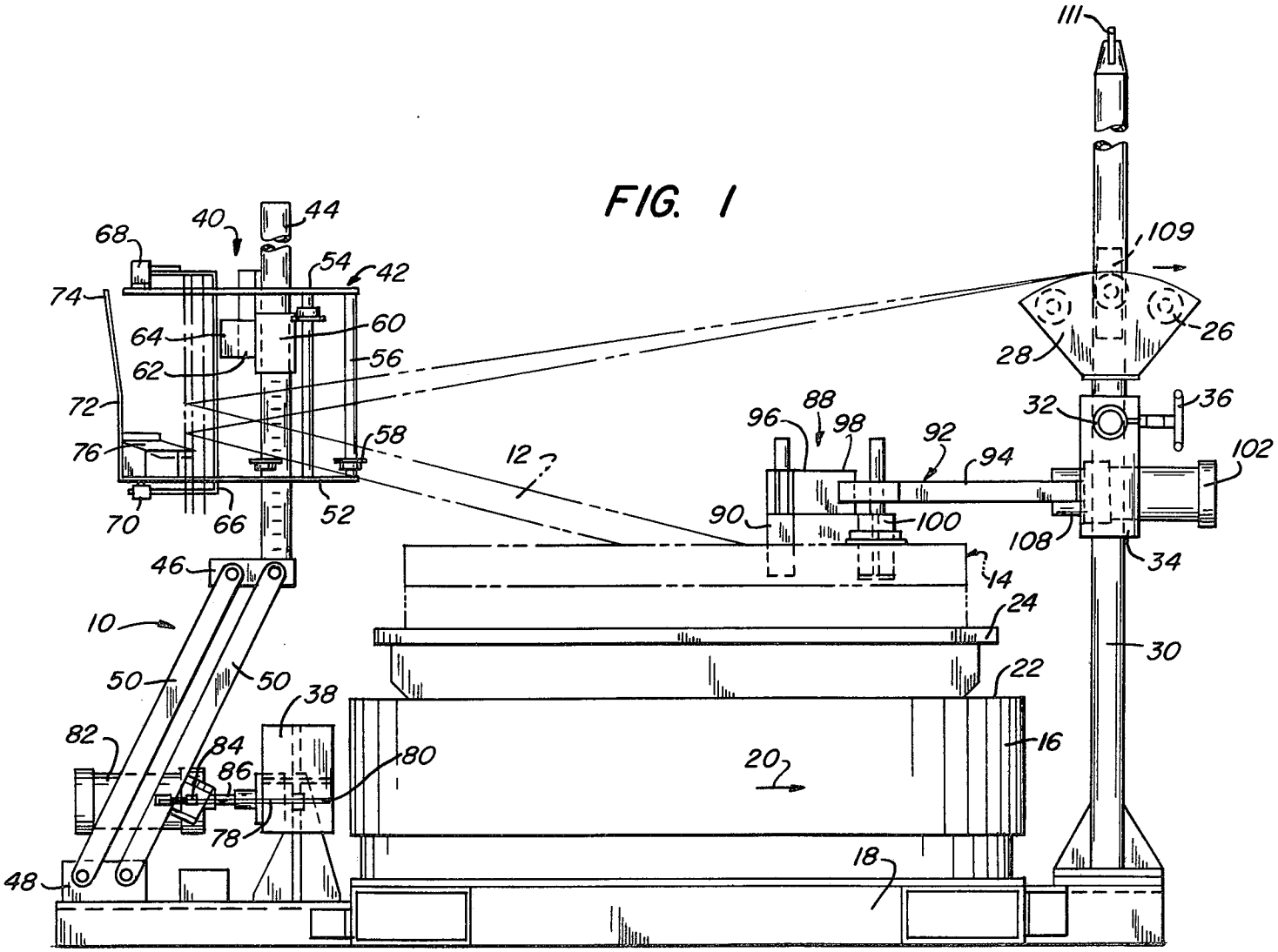
FIG. 1 is an elevational view of apparatus according to the present invention.
Figure 2:
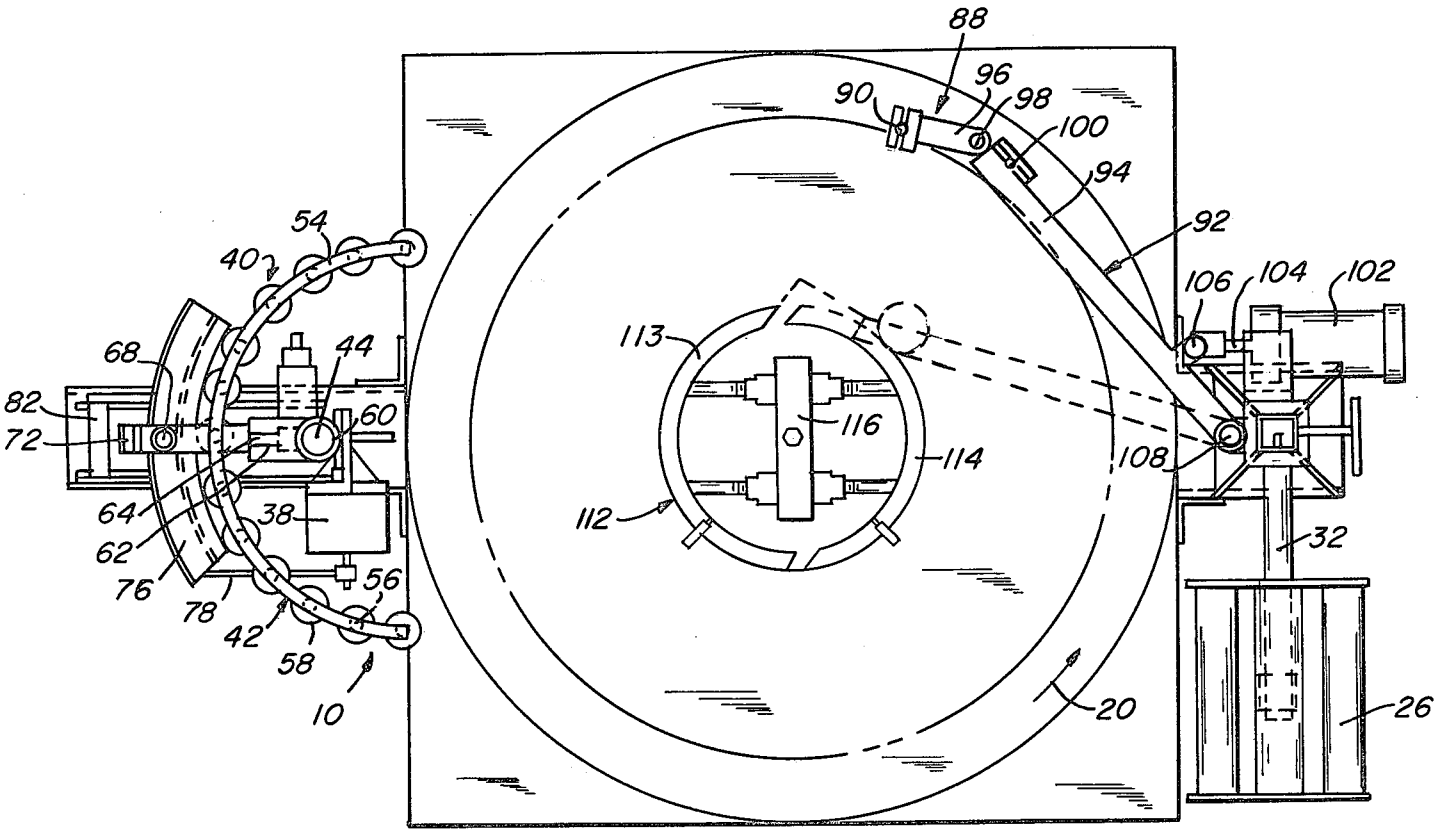
FIG. 2 is a plan view of the apparatus of FIG. 1.

Accordingly, the present invention provides apparatus for feeding strip material from a wound coil to a work processing station comprising a turntable adapted to mount a strip coil for rotation about a vertical axis in the strip unwind direction, means for rotatably driving said turntable, and means operably connected to said driving means for controlling the rotational speed of said turntable including a base disposed on the remote side of said turntable from the strip discharge side of said apparatus, a turntable drive control interposed between said turntable and said base, an upstanding post vertically spaced from said base and adapted for translational movement toward and away from said drive control in response to tension on the strip being fed, a frame assembly connected to said post adapted to be embraced by strip material unwound from said coil as it passes toward the strip discharge side of said apparatus, link means pivotally connected at its opposite ends to said base and the lower end of said post respectively, and means connecting said link means to said drive control to regulate the same in response to the position of said link means.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

The drawings illustrate sheet metal strip feeding apparatus 10 that is particularly adapted for the controlled unwinding of strip material 12 from a coil construct 14 having a vertical coil axis and for twisting the strip through approximately ninety degrees for delivery to a strip processing station (not shown). The apparatus comprises a turntable 16 mounted for rotation on a base 18. Appropriate electrically-operated drive means of well-known construction (not shown) housed within the base 18 are adapted to drive the turntable in the direction of the arrow 20. The turntable 16 is provided on its upper surface 22 with a horizontally disposed platform 24 adapted to receive the coil construct 14, which, as shown, contains a plurality of vertically-spaced coiled strips 12 and is rested on end for rotation about a vertical axis.

Although desirable, it is not necessary that the construct 14 be accurately positioned in coaxial relation with the platform 24 as the affected parts of the apparatus 10 are equipped with sufficient lateral play to accommodate eccentric turning of the construct. For the sake of the description, therefore, "rotation" about a vertical axis should be understood to also mean eccentric turning about such axis.

Figure 3:
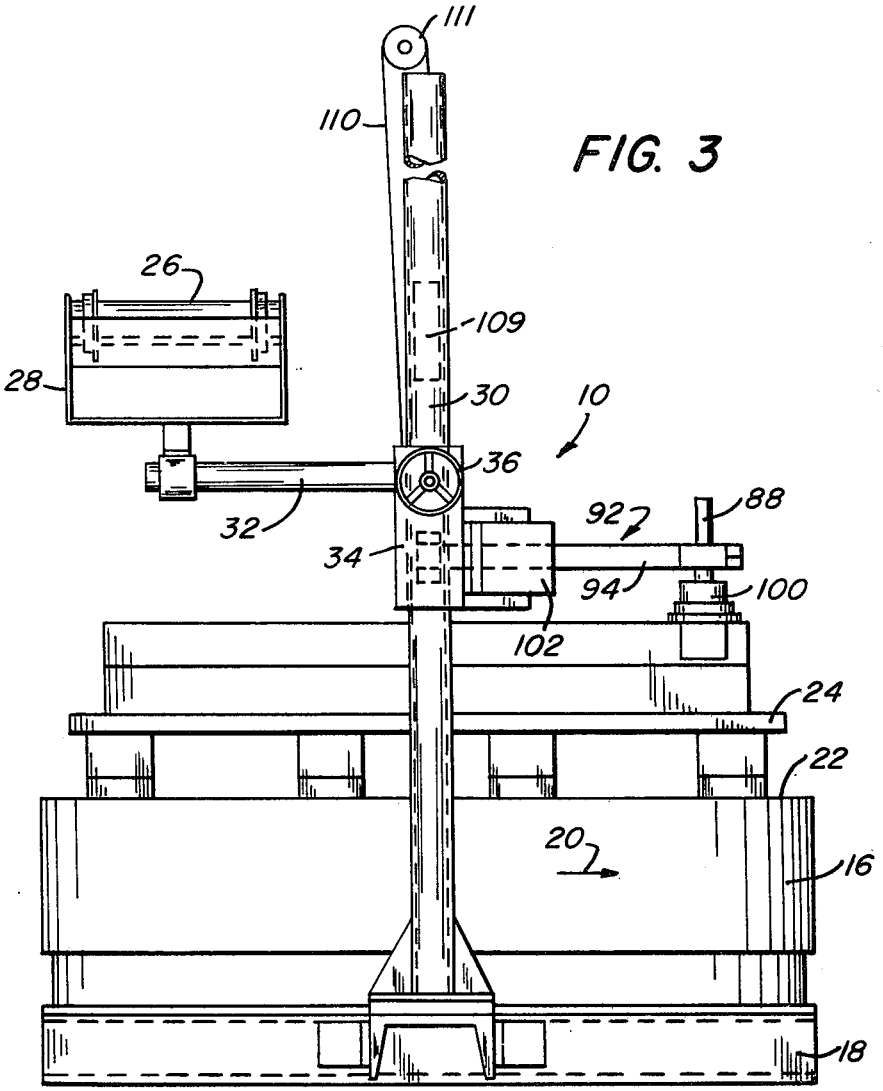
FIG. 3 is a frontal elevational view of the apparatus of FIG. 1.

A set of strip guide rolls 26 journalled for horizontal rotation in a frame 28 are disposed at the discharge end of the apparatus, intermediate the turntable 16 and the strip processing station. The frame 28 is adapted for vertical positional adjustment upon a stationary post, termed the accessory post 30. As shown in FIG. 3, the frame 28 is mounted to the post 30 by means of an elongated rod 32 that extends horizontally from a slidable sleeve 34 whose position on the post 30 is set by a handwheel operated set screw 36. The strip guide rolls 26 are desirably positioned at a location vertically spaced above the top of the construct and radially outwardly of its axis of rotation.

On the side of the turntable 16 remote from the guide rolls 26 the apparatus 10 is provided with a turntable motor drive control 38 and a movable strip guide assembly, indicated generally as 40, that is operatively connected to the control 38 for regulating the rate of rotation of the turntable 16 in response to the tension on the strip 12 unwound from construct 14. Control 38 is a conventional rheostat-operated proportional controller which is adapted to adjust electric current to the turntable drive motor in response to positional changes in the strip guide assembly 40.

The strip guide assembly 40 includes a guide frame 42 about which the strip 12 is looped in passing from the construct 14 to the discharge end of the apparatus represented by the stationary guide rolls 26. The guide frame 42 is mounted upon a vertically upstanding post 44 extending from a post base 46. The post base 46 is connected to pivot mount 48 by a pair of parallel links 50 whose opposite ends are pivotally connected to the post base 46 and pivot mount 48 respectively so as to maintain the post in a vertical attitude as it is moved back and forth in a vertical plane under the urging of tension on strip 12. The guide frame 42 includes a pair of oppositely-spaced frame members 52, 54 formed essentially as arcuate curves and between which are journalled a plurality of rotatable guide pins 56. Collars 58 fixed at alternate ends of the pins serve to limit the extent of travel of the strip laterally of the frame.

In order to accommodate twisting of the strip 12, the guide frame 42 is connected to the post 44 for pivotal movement about axes that are parallel to the post and normal thereto. Accordingly, connection is effected by means of a hollow cylindrical sleeve 60 received on the post 44 and having an integrally-formed pivot mount 62 extending normally therefrom. Pivot mount 62 contains a bearing cavity for reception of a pivot pin 64 extending from a yoke 66, the opposite ends of which are pivotally connected by means of pins 68, 70 to the respective frame members 52, 54.

The remote side of guide frame 42 is provided with a strip guard 72 upstanding from the lower frame member 52. The upper end of guard 72 may be outwardly offset, as shown in FIG. 1 at 74, in order to facilitate initial placement of the strip 12 in the frame. A spiral plate 76 attached to the lower plate member 52 serves to retain the strip 12 in an intermediate position between the frame members 52, 54 during periods when due to insufficient tension in the strip 12 it may fall out of engagement with the guide pins 56.

The guide frame assembly 40 is operatively connected to the turntable drive control 38 by means of a connecting rod 78 attached at one end to one of the pivot links 50 and whose free end 80 connects with the control to vary the resistance of the contained rheostat (not shown) in response to the position of the assembly. A constant pressure cylinder 82 attached to the link 50 by means of bracket 84 has its piston rod 86 fixed to the control 38 and operates to urge the frame assembly backwardly against the tension in the strip 12 as hereinafter more fully explained.

The strip feeding apparatus disclosed in the drawings is particularly adapted to accommodate sheet metal strip material 12 from a construct 14 that has been partially slit in accordance with the teaching of U.S. Pat. Nos. 4,155,238 and 4,170,691 granted May 22, 1979 and Oct. 9, 1979 respectively to J. W. Rogers wherein an elongated web of sheet metal is slit along parallel lines (13 in FIG. 1) in a manner that produces parting lines containing intermittently-spaced tabs (not shown) formed of residua of only partially-sheared metal bridging the interstice between adjacent strips 12. Accordingly, the disclosed apparatus 10 includes means for separating individual strips 12 from the construct such that the same can be unwound for feeding to a processing station. The strip separating means, indicated generally as 88, comprises a prizing tool 90 adapted to be interposed between the two outermost wraps of strip material in bearing engagement with the inner of the two wherein the outer wrap is caused to traverse the tool thereby causing the tabs interconnecting the strip 12 from the remaining construct to be sheared in tension. The tool 90 and its operation is described in detail in U.S. patent application Ser. No. 55,848 filed July 9, 1979 to J. W. Rogers, abandoned.

As shown, in the present arrangement the prizing tool 90 is attached at the free end of an articulated arm 92 that is pivotally mounted on the stationary post 30. The arm 92 is formed of two link members 94 and 96 termed the snubber arm and the trailing arm, respectively, that are hingedly connected at 98. The snubber arm 94 attaches a snubber roll 100 adapted to bear on the exterior of the strip coil just forward of the prizing tool 90 under the urging of a constant pressure fluid cylinder 102 whose connecting rod 104 pivotally attaches to the snubber arm through a pin connection 106.

In the described arrangement, the arm 92 attaches to the sleeve 34 through pin connection 108 in order that the entire assembly including guide rolls 26 and the strip separating means can, for the sake of convenience, be vertically adjusted in unison on the post 30. A counterweight 109 attached via cable 110 over pulley 111 facilitates adjustment of the sleeve 34 with its attached members upon the post 30.

A core 112 formed of arcuate segments 113, 114 that are oppositely extendable through a turnbuckle 116 may be disposed in the axial opening 118 in the construct 14 for the purpose of laterally supporting the innermost wraps of strip material to enable fracture of the tabs in this region.

The operation of the described apparatus is as follows. A construct 14 consisting of a plurality of interconnected coils of strip 12 is set on end on the turntable platform 24 with part of the strip preliminarily detached and unwound from the construct, looped through the guide frame 42 of strip guide assembly 40 in embracing relation to the guide pins 56 and extended across the guide rolls 26 with its leading end attached to the strip feed mechanism at the processing station (not shown).

Sleeve 60 is positioned on post 44 to place prizing tool 90 on arm 92 in engagement with the surface of the strip to be detached from construct 14 intermediate the outermost wrap and the next adjacent wrap thereof. Snubber roll 100 is at the same time brought to bear on the exterior surface of the outer wrap under the urging of cylinder 102. These elements are thus positioned such that movement of strip material across the tool 100 causes the outermost wrap to be drawn outwardly of the construct outer periphery thereby effecting fracture of the interconnecting tabs.

Guide frame 42 is positioned on the movable post 44 at an elevation above the upper end of the construct 14 sufficient to permit looping and twisting of the strip 12 without imposing undue stress on the material that could create the danger of damage due to kinking.

Thereafter the strip feed mechanism at the processing station and the drive motor for the turntable 16 are actuated to cause the construct 14 to rotate the strip unwind direction and the strip 12 to be continuously drawn across the guide rolls 26. Rotation of the construct 14 causes the strip 12 to be continuously moved across the tool 100 thereby fracturing the interconnecting tabs in sequence and permitting the severed strip to pass through the guide frame 42. Since the guide frame 42 is permitted to pivot about axes both parallel to and normal of the movable post 44 twisting of the strip from a surface-vertical attitude to a surface-horizontal attitude is readily accommodated.

It will be appreciated that any variation in the rate at which the strip 12 is fed to the processing station by its associated feed mechanism will alter the tension in the strip that is looped through the guide frame 42 causing that member to undergo movement with respect to the pivot mount 48. An increase in the strip feed rate at the processing station results in a proportional increase in strip tension causing the guide frame to move to the right in FIG. 1 thereby effecting an appropriate adjustment in the drive control 38 to increase the rate of rotation of turntable 14 and, concomitantly, the rate at which strip is severed from the construct 14 and passed through the apparatus. As the strip feed rate is increased in response to demand the tension in the material is reduced causing the guide frame to move toward the left under the urging of cylinder 82, which member is, in effect, a soft, constant pressure spring, until an equilibrium rate is achieved.

It will be understood that various changes in the details, materials and arrangements of parts which have been herein described and illustrated in order to explain the nature of the invention, may be made by those skilled in the art within the principle and scope of the invention as expressed in the appended claims.

We claim:

1. Apparatus for feeding strip material from a wound coil to a work processing station comprising:

(a) a turntable adapted to mount a strip coil for rotation about a vertical axis in the strip unwind direction;

(b) means for rotatably driving said turntable; and (c) means operably connected to said driving means for controlling the rotational speed of said turntable including:

(i) a base disposed on the remote side of said turntable from the strip discharge side of said apparatus;

(ii) a turntable drive control interposed between said turtable and said base;

(iii) an upstanding post vertically spaced from said base and adapted for translational movement toward and away from said drive control in response to tension on the strip being fed;

(iv) a frame assembly connected to said post adapted to be embraced by strip material unwound from said coil as it passes toward the strip discharge side of said apparatus;

(v) link means pivotally connected at its opposite ends to said base and the lower end of said post respectively; and (vi) means connecting said link means to said drive control to regulate the same in response to the position of said link means.

2. Apparatus according to claim 1 including constant force means connected to said link means to move the same away from said drive control when strip tension falls below a predetermined value.

3. Apparatus according to claim 2 in which said constant force means comprises a cylinder and fluid operated piston one of which members is fixed and the other of which is attached to said link means; and means for supplying fluid at a constant pressure to said cylinder.

4. Apparatus according to claim 1 in which said frame assembly includes a plurality of guide pins arranged with respect to one another to define a path of travel for said strip that is substantially convex away from the discharge side of said apparatus.

5. Apparatus according to claim 4 in which said frame assembly is connected to said post for pivotal movement about a first axis that is normal to the axis of said post and about a second axis normal to said first axis.

6. Apparatus according to claim 5 in which said frame assembly comprises:

(a) a yoke;

(b) means connecting said yoke to said post for pivotal movement about a generally horizontal axis;

(c) oppositely spaced frame members for attaching the ends of said guide pins, said frame members being connected each to one end of said yoke for pivotal movement about an axis normal to said horizontal axis.

7. Apparatus according to claim 6 in which said guide pins are rotatably mounted in said frame members.

* * * * *